US009522539B2

(12) United States Patent
Nakamaki

(10) Patent No.: US 9,522,539 B2
(45) Date of Patent: Dec. 20, 2016

(54) RECORDING DEVICE, METHOD OF CONTROLLING A RECORDING DEVICE, AND A STORAGE MEDIUM STORING A PROGRAM RUN BY A CONTROL UNIT THAT CONTROLS THE RECORDING DEVICE

(71) Applicant: Seiko Epson Corporation, Shinjuku-ku (JP)

(72) Inventor: Motohiro Nakamaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/490,505

(22) Filed: Sep. 18, 2014

(65) Prior Publication Data

US 2015/0002578 A1 Jan. 1, 2015

Related U.S. Application Data

(63) Continuation of application No. 13/433,770, filed on Mar. 29, 2012, now Pat. No. 8,870,334.

(30) Foreign Application Priority Data

Nov. 2, 2011 (JP) ..... 2011-240927

(51) Int. Cl.

| | |
|---|---|
| ***B41J 2/165*** | (2006.01) |
| ***B41J 2/21*** | (2006.01) |
| ***B41J 29/393*** | (2006.01) |
| ***B41J 11/66*** | (2006.01) |

(52) U.S. Cl.

CPC ..... *B41J 2/16505* (2013.01); *B41J 2/16579* (2013.01); *B41J 2/2142* (2013.01); *B41J 11/663* (2013.01); *B41J 29/393* (2013.01)

(58) Field of Classification Search

USPC ..... 347/16, 19, 23, 14

See application file for complete search history.

(56) References Cited

U.S. PATENT DOCUMENTS

| | | | | |
|---|---|---|---|---|
| 2011/0115841 | A1* | 5/2011 | Ito | B41J 2/16579 347/14 |
| 2011/0261105 | A1* | 10/2011 | Makley | B41J 11/009 347/19 |
| 2012/0236061 | A1* | 9/2012 | Yudasaka | B41J 2/16508 347/16 |

FOREIGN PATENT DOCUMENTS

| | | | | |
|---|---|---|---|---|
| JP | 2000-108327 A | | 4/2000 | |
| JP | 2006-198924 A | | 8/2006 | |
| JP | 2006-198924 | * | 9/2006 | B41J 2/175 |
| JP | 2008-221731 A | | 9/2008 | |

OTHER PUBLICATIONS

Non-Final Rejection of Oct. 10, 2013 in related U.S. Appl. No. 13/433,770—15 pages.

* cited by examiner

*Primary Examiner* — Kristal Feggins
(74) *Attorney, Agent, or Firm* — Kilpatrick Townsend & Stockton LLP

(57) ABSTRACT

User concerns caused by a time lag between issuing a command for a specific operation and the start of the specific operation are reduced without reducing the accuracy of ejection problem detection by a nozzle check process. The nozzle check execution unit of an inkjet printer monitors if a cut button is pressed while a nozzle check process is in progress, interrupts the nozzle check process if the button is pressed, and after the cutting process ends, resumes the nozzle check process and checks the nozzles that have not been tested for ejection problems.

15 Claims, 6 Drawing Sheets

RECORDING DEVICE, METHOD OF CONTROLLING A RECORDING DEVICE, AND A STORAGE MEDIUM STORING A PROGRAM RUN BY A CONTROL UNIT THAT CONTROLS THE RECORDING DEVICE

CROSS REFERENCE TO RELATED APPLICATIONS

This application is a continuation of U.S. patent application Ser. No. 13/433,770, filed Mar. 29, 2012, which claims the priority to Japanese Patent Application No. 2011-240927, filed on Nov. 2, 2011, the entire disclosures of which are incorporated by reference herein.

BACKGROUND

1. Technical Field

The present invention relates to a recording device that has a recording head with a plurality of nozzles and performs a nozzle check process that checks each nozzle for ejection problems. The invention also relates to a method of controlling the recording device, and a program for controlling the recording device.

2. Related Art

Recording devices (printers) capable of performing a nozzle check process that detects ejection problems in the nozzles of a recording head are known from the literature. See, for example, Japanese Unexamined Patent Appl. Pub. JP-A-2006-198924.

The nozzle check process is an operation that is performed for the purpose of checking all of the nozzles for ejection problems, and therefore sequentially checks each of the nozzles for an ejection problem. A relatively long time is required from when the nozzle check starts until the completion of checking all nozzles for an ejection problem.

If an operation that cannot be performed at the same time as the nozzle check process is commanded while the nozzle check process is in progress, the recording device according to the related art performs that operation after the nozzle check process is completed. In this situation the instructed operation may not be executed for a relatively long time, and the user that issued the command to perform the operation may wonder if there is a problem. When a command to perform another operation is asserted while the nozzle check process is in progress, the nozzle check process could conceivably be interrupted and the operation performed, but this results in incomplete detection of ejection problems and can lead to reducing the accuracy of ejection problem detection by the nozzle check process.

SUMMARY

An object of the present invention is to reduce user concerns caused by the time lag between when a command for a specific operation is asserted and the start of the specific operation without reducing the accuracy of ejection problem detection by the nozzle check process.

One aspect of the invention is a recording device that includes a recording head having a plurality of nozzles; and a nozzle check execution unit that performs a nozzle check process of detecting ejection problems of the plural nozzles, sequentially detects ejection problems in a plurality of nozzles after starting the nozzle check process, monitors assertion of a command for performing a specific operation that cannot be performed simultaneously to the nozzle check process, and if executing the specific operation is commanded, interrupts the nozzle check process, performs the specific operation, and then resumes the nozzle check process.

Because the nozzle check process is interrupted, the specific operation is performed, and the nozzle check process is then resumed if executing a specific operation that cannot be performed at the same time as the nozzle check process is commanded while the nozzle check process is in progress, this aspect of the invention can shorten the time lag until the specific operation starts after executing the specific operation is commanded, and can alleviate user concerns caused by the time lag. Furthermore, because this configuration resumes the nozzle check process after executing the specific operation, detection of ejection problems by the nozzle check process is not completed only partially, and detection accuracy does not drop.

Preferably, after resuming the nozzle check process, the nozzle that had not been checked for ejection problems when the nozzle check process was interrupted is checked for ejection problems.

Because this aspect of the invention checks all nozzles for ejection problems even if the nozzle check process is interrupted, the accuracy of ejection problem detection by the nozzle check process does not drop.

Preferably, the specific operation is an operation that affects the accuracy of detecting ejection problems by the nozzle check execution unit.

This aspect of the invention prevents the nozzle check process and an operation that affects the accuracy of ejection problem detection by the nozzle check execution unit from being performed at the same time, and can therefore reduce user uncertainty.

Further preferably, the nozzle check execution unit ejects ink droplets from the nozzle onto a conductor, detects current flowing through the conductor, and based on the detected current determines if there is an ink ejection problem; and the operation that affects detection accuracy is an operation that produces noise that can adversely affect current detection.

By preventing executing operations that have an adverse effect on the accuracy of detecting ejection problems while the nozzle check process is in progress according to the status of the nozzle check process, this aspect of the invention can alleviate user concerns resulting from the time lag between when a specific operation is commanded and the start of the specific operation without reducing the accuracy of ejection problem detection by the nozzle check process.

In another aspect of the invention, the recording device also has a cutter unit that cuts a recording medium recorded on by the recording head; wherein the operation that affects detection accuracy is an operation that cuts the recording medium by the cutter unit.

When the recording medium is cut with the cutter unit, noise that adversely affects detection of current flow in the conductor could be produced by the physical vibrations accompanying driving the cutting mechanism and the drive current supplied to drive the motor.

By preventing executing operations that have an adverse effect on the accuracy of detecting ejection problems while the nozzle check process is in progress according to the status of the nozzle check process, this aspect of the invention can alleviate user concerns resulting from the time lag between when a specific operation is commanded and the start of the specific operation without reducing the accuracy of ejection problem detection by the nozzle check process.

A recording device according to another aspect of the invention also has an input unit that can input a command for cutting the recording medium by the cutter unit.

This aspect of the invention can alleviate user concerns resulting from the time lag between when cutting is commanded and when cutting starts after a command for desirably cutting the recording medium is input through the input unit even if the cut command is input from the input unit while the nozzle check process is in progress.

A recording device according to another aspect of the invention also has a cover than can open and close; wherein the nozzle check execution unit determines if the cover is open while executing the nozzle check process, and if the cover is determined to be open, stops the nozzle check process until the cover is determined to be closed.

If the device cover is open, the user may be performing a task such as setting recording medium in the recording device, and the accuracy of ejection problem detection by the nozzle check process could be adversely affected by this task. If the cover is open, this aspect of the invention therefore stops the nozzle check process until the cover closes, and can thereby eliminate adverse effects on the accuracy of ejection problem detection by the nozzle check process due to the cover being open.

In another aspect of the invention, if executing the specific operation is instructed after a specific time has passed after the nozzle check process starts, the nozzle check execution unit executes the specific operation after completing the nozzle check process without interrupting the nozzle check process.

However, if executing a specific operation is commanded when the nozzle check process will soon end, performing the specific operation after the nozzle check process ends is more efficient, the time lag between when executing the specific operation is commanded and when the specific operation starts is also short, and user concerns are limited. As a result, when executing a specific operation is commanded after a specific time has passed after the nozzle check process starts, this aspect of the invention performs the specific operation after completing the nozzle check process without interrupting the nozzle check process, and user concerns can therefore be suppressed and process efficiency improved.

Another aspect of the invention is a method of controlling a recording device having a recording head with a plurality of nozzles, including steps of: after starting execution of a nozzle check process that detects ejection problems of the plural nozzles, sequentially detecting ejection problems in a plurality of nozzles after starting the nozzle check process, monitoring assertion of a command for executing a specific operation that cannot be performed simultaneously to the nozzle check process, and if executing the specific operation is commanded, interrupting the nozzle check process, performing the specific operation, and then resuming the nozzle check process.

Because the nozzle check process is interrupted, the specific operation is performed, and the nozzle check process is then resumed if executing a specific operation that cannot be performed at the same time as the nozzle check process is commanded while the nozzle check process is in progress, this control method can shorten the time lag until the specific operation starts after executing the specific operation is commanded, and can alleviate user concerns caused by the time lag. Furthermore, because this configuration resumes the nozzle check process after executing the specific operation, detection of ejection problems by the nozzle check process is not completed only partially, and detection accuracy does not drop.

In a recording device control method according to another aspect of the invention, after resuming the nozzle check process, the nozzle that had not been checked for ejection problems when the nozzle check process was interrupted is checked for ejection problems.

Because this control method checks all nozzles for ejection problems even if the nozzle check process is interrupted, the accuracy of ejection problem detection by the nozzle check process does not drop.

Another aspect of the invention is a storage medium storing a program that is executed by a control unit that controls parts of a recording device having a recording head with a plurality of nozzles, the program causing the control unit to function as a nozzle check execution unit that, after starting execution of a nozzle check process that detects ejection problems of the plural nozzles, sequentially detects ejection problems in a plurality of nozzles after starting the nozzle check process, monitors assertion of a command for performing a specific operation that cannot be performed simultaneously to the nozzle check process, and if executing the specific operation is commanded, interrupts the nozzle check process, performs the specific operation, and then resumes the nozzle check process.

Because the nozzle check process is interrupted, the specific operation is performed, and the nozzle check process is then resumed if executing a specific operation that cannot be performed at the same time as the nozzle check process is commanded while the nozzle check process is in progress, running this program can shorten the time lag until the specific operation starts after executing the specific operation is commanded, and can alleviate user concerns caused by the time lag. Furthermore, because this configuration resumes the nozzle check process after executing the specific operation, detection of ejection problems by the nozzle check process is not completed only partially, and detection accuracy does not drop.

Effect of the Invention

The invention can reduce user concerns caused by the time lag between when a command for a specific operation is asserted and the start of the specific operation without reducing the accuracy of ejection problem detection by the nozzle check process.

DESCRIPTION OF EMBODIMENTS

A preferred embodiment of the present invention is described below with reference to the accompanying figures.

Embodiment 1

Figure 1:
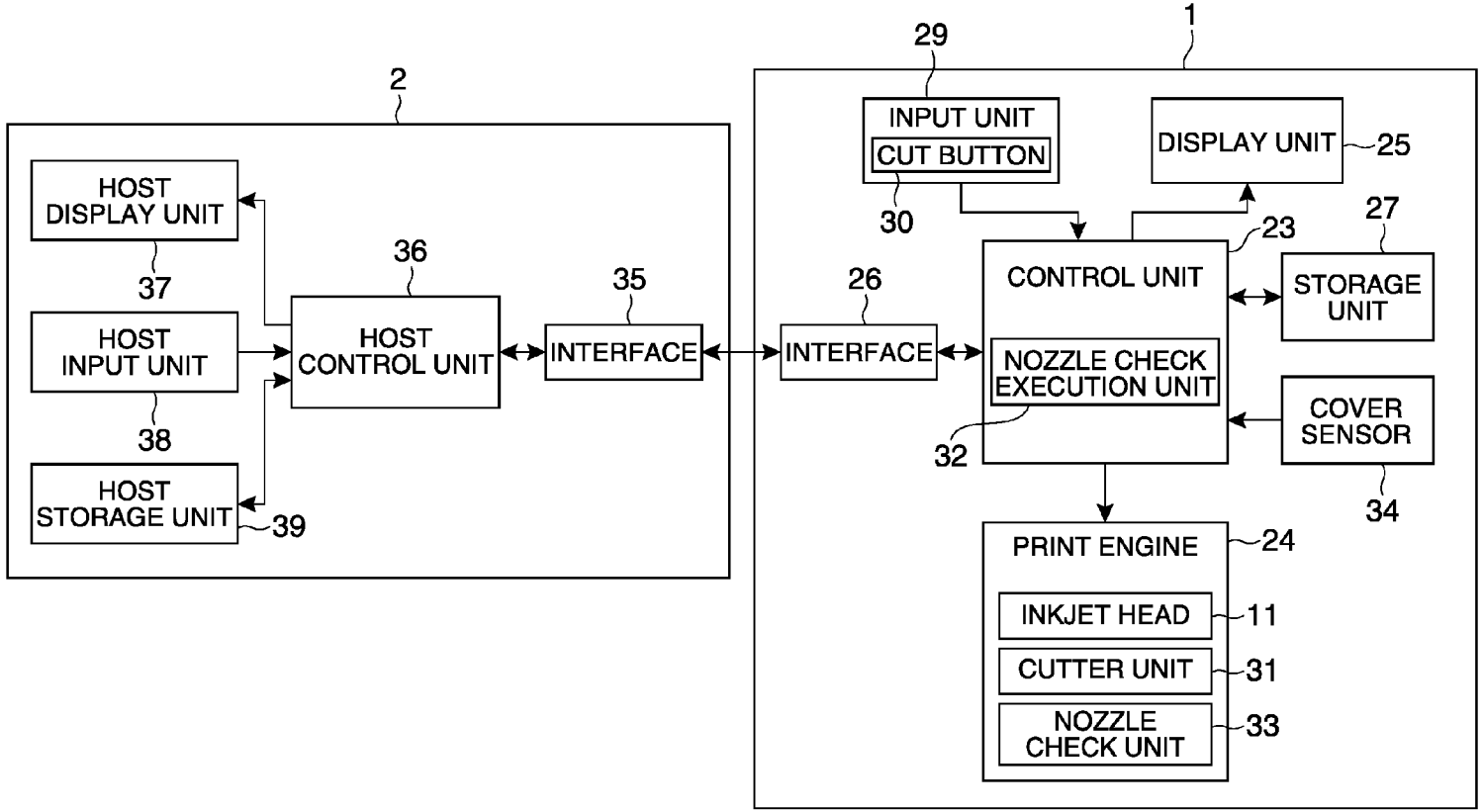
FIG. 1 is a block diagram showing the configuration of an inkjet printer according to a first embodiment of the invention.

FIG. 1 is a block diagram showing the functional configuration of an inkjet printer 1 (recording device) and a host computer 2 that controls the inkjet printer 1.

The inkjet printer 1 is an inkjet printer that has an inkjet head 11 (recording head) and outputs tickets on which an image is recorded by ejecting ink from plural nozzles formed in the inkjet head 11 onto roll paper as the recording medium, and then cutting the roll paper at a specific position after recording an image on the roll paper. The inkjet printer 1 is used to produce receipts and coupons, for example.

As shown in FIG. 1, the inkjet printer 1 has a control unit 23, print engine 24, display unit 25, input unit 29, interface 26, storage unit 27, and cover sensor 34.

The control unit 23 centrally controls parts of the inkjet printer 1, and includes a CPU as a central processor, ROM that nonvolatilely stores firmware that is run by the CPU, RAM that temporarily stores programs run by the CPU and program data, and other peripheral circuits. The control unit 23 also has a nozzle check execution unit 32, which is described further below.

While monitoring the output values of various sensors, the print engine 24 operates the inkjet head 11 described above, the paper feed motor that drives the paper feed rollers to convey the roll paper, and a carriage drive motor that drives the carriage and moves the inkjet head 11 in the primary scanning direction to form dots according to the image to be recorded on the roll paper as controlled by the control unit 23.

The print engine 24 also has a cutter unit 31. The cutter unit 31 is a member that cuts the roll paper, includes a fixed knife and a movable knife, and has a cutter drive motor for driving the movable knife connected to the movable knife. The control unit 23 cuts the roll paper by driving the cutter drive motor and driving the movable knife.

The print engine 24 also has a nozzle check unit 33. The nozzle check unit 33 is a mechanism for executing the nozzle check process. The nozzle check process using the nozzle check unit 33 is described below.

The display unit 25 includes an LCD panel or other display panel, and displays information on the display panel as controlled by the control unit 23.

The input unit 29 is connected to operating switches disposed to the inkjet printer 1, detects operation of the operating switches, and outputs to the control unit 23.

More specifically, the input unit 29 is connected to a cut button 30. The cut button 30 is a button enabling the user to issue a command for the cutter unit 31 to cut the roll paper. When the user operates the cut button 30, the control unit 23 controls the cutter unit 31 to cut the roll paper.

The interface 26 communicates with the host computer 2 according to a known protocol as controlled by the control unit 23.

The storage unit 27 is rendered by EEPROM or a hard disk drive, for example, and stores data rewritably.

The cover sensor 34 is a sensor that detects if a cover (not shown in the figure) of the inkjet printer 1 case is open or closed. This cover is a member that covers the opening for loading roll paper into the printer, and the control unit 23 detects whether the cover is open or closed based on output from the cover sensor 34. Note that while not shown in FIG. 1 the inkjet printer 1 has a number of other sensors including a sensor that detects paper jams and a sensor that detects when there is no paper.

As shown in FIG. 1, the host computer 2 has a host control unit 36 that centrally controls parts of the host computer 2; a host display unit 37 that displays information on a display panel; a host input unit 38 that detects operation of the input devices and outputs to the host control unit 36; a host storage unit 39 that rewritably stores data; and a host-side communication interface 35 for communicating with the inkjet printer 1 and performing other communication processes.

A printer driver for controlling the inkjet printer 1 is installed to the host computer 2, and to record an image on the roll paper, the host control unit 36 generates and outputs to the inkjet printer 1 control commands for performing operations related to recording an image on the roll paper by reading and running the printer driver.

Based on the input control commands, the control unit 23 of the inkjet printer 1 controls the print engine 24 and executes the recording operations.

The nozzle check process is described next.

Figure 2:
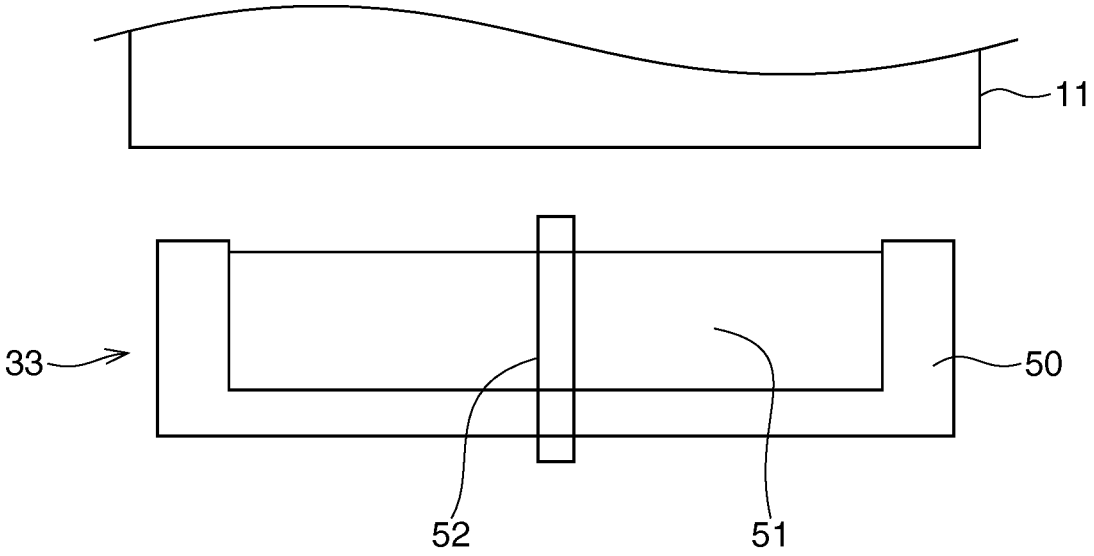
FIG. 2 illustrates the nozzle check unit.

FIG. 2 schematically shows the nozzle check unit 33 from the side. More specifically, FIG. 2 shows the nozzle check unit 33 from a horizontal position when the ink ejection direction is vertical. FIG. 2 also shows the inkjet head 11, which has a plurality of nozzles formed in the bottom surface, when moved to the position opposite the nozzle check unit 33 to perform the nozzle check process.

In FIG. 2, an absorbent sponge container 50 that is shaped like a box with an open top is disposed directly below the inkjet head 11. An absorbent sponge 51 is held in the sponge container 50, and a conductor 52 is electrically connected to the sponge 51. The sponge 51 covers the entire area of the nozzle surface in which the nozzles of the inkjet head 11 are formed, and is configured so that ink ejected from any nozzle will land on the sponge 51. The nozzle check unit 33 is also configured so that electrical signals flowing through the conductor 52 are output to a specific signal processing circuit. In addition, while not shown in the figure, an electrode for charging the ink ejected from the nozzles is disposed near the nozzles of the inkjet head 11.

Configured as described above, the nozzle check execution unit 32 detects ejection problems in each nozzle of the inkjet head 11 as described below. More specifically, the nozzle check execution unit 32 ejects a specific volume of ink droplets from the nozzle being checked for ejection problems. The ejected ink droplets are charged with a specific charge by the electrode before landing on the sponge 51. The current state of the conductor 52 changes when the ink droplets land, and a signal representing the change is output through a specific signal processing circuit to the control unit 23. The nozzle check execution unit 32 determines that the expected amount of ink was ejected normally and there is no ejection problem with the tested nozzle if the value indicated by the input signal exceeds a specific threshold, but if the value is below the threshold, determines that the expected amount of ink was not discharged for some reason and there is an ejection problem with the tested nozzle.

A normal nozzle check process checks every nozzle of the inkjet head 11 in a specific order, and sequentially detects if there is an ejection problem. More specifically, every nozzle of the inkjet head 11 is checked for an ejection problem by ejecting ink and detecting the current state one nozzle at a time in a specific order in the nozzle check process. As a result, a relatively long time is required from when the nozzle check process starts until detection of ejection problems is completed for all nozzles.

Note that the function of the nozzle check execution unit 32 is achieved by cooperation of hardware and software, such as the CPU of the control unit 23 reading and running firmware.

The nozzle check process and the process of cutting the roll paper with the cutter unit 31 are processes that cannot run simultaneously in this embodiment of the invention. The reason for this is described below.

As described above, the nozzle check process detects if an ejection problem has occurred in each nozzle by detecting current flow through the conductor 52. However, if the roll paper is cut by the cutter unit 31 while the nozzle check process is in progress, noise that adversely affects detection of current flow in the conductor 52 is produced by the physical vibration accompanying driving the movable knife and the drive current supplied to drive the cutter drive motor, and this noise can interfere with normal detection.

As a result, the inkjet printer 1 according to the related art is configured so that the nozzle check process and the process related to cutting the roll paper with the cutter unit 31 are not performed at the same time. This configuration prevents problems resulting from the nozzle check process and the process of cutting the roll paper with the cutter unit 31 executing at the same time, but creates the following problems.

Figures 3A, 3B:
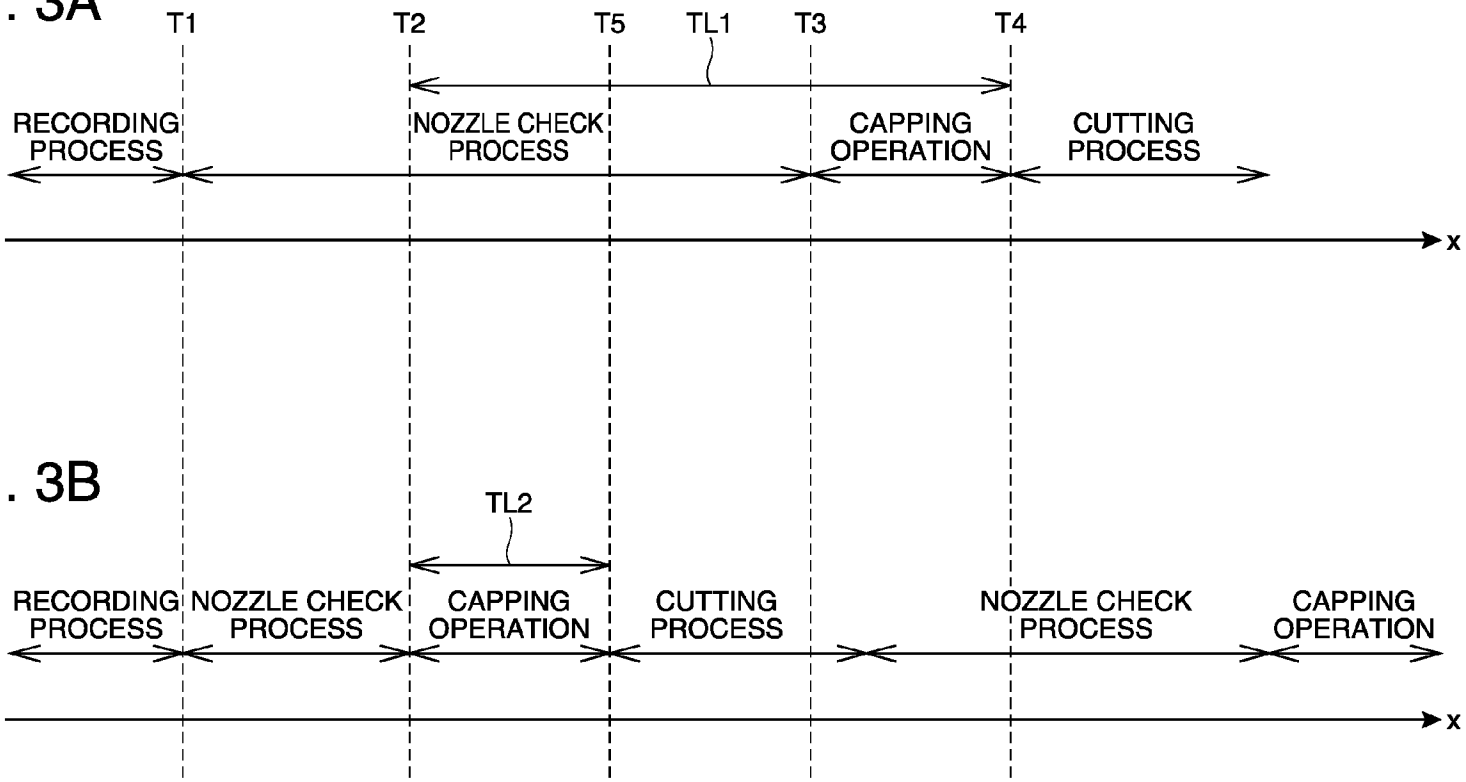
FIGS. 3A and 3B show the timing of processes performed by the printer on a time line.

FIG. 3A describes a problem with an inkjet printer 1 according to the related art. FIG. 3A shows the timing of the start and end times of the processes performed when the cut button 30 is pressed when the nozzle check process is performed after recording an image on the roll paper is completed.

In FIG. 3A the x-axis shows the passage of time with time progressing from the left to the right in the figure.

As shown in FIG. 3A, the image recording process ends and the nozzle check process starts at time T1. The user then presses the cut button 30 at time T2 and issues a command to cut the roll paper with the cutter unit 31 while the nozzle check process is in progress.

In this case, the process of cutting the roll paper with the cutter unit 31 does not start in the inkjet printer 1 according to the related art until the nozzle check process ends at time T3 and the capping operation is completed at time T4, and the process of cutting the roll paper with the cutter unit 31 (the "cutting process" below) starts at time T4 when the capping operation ends. Note that the capping operation is a process that covers the nozzle surface of the inkjet head 11 with a cap not shown to prevent ink left in the nozzles of the inkjet head 11 from drying or become viscous.

This creates a time lag TL between time T2 when the cut button 30 is pressed and time T4 when the process to cut the roll paper with the cutter unit 31 starts. As described above, because a relatively long time is required to complete the nozzle check process, this time lag TL could be long enough to make the user concerned.

If the cut button 30 is pressed while the nozzle check process is in progress, stopping the nozzle check process and executing the process to cut the roll paper with the cutter unit 31 is conceivable. However, this can result in the nozzles of the inkjet head 11 only being partially checked for ejection problems, and lead to less accurate detection of ejection problems by the nozzle check process.

As a result, by performing the operation described below, the inkjet head 11 according to this embodiment of the invention reduces user concerns caused by the time lag until cutting starts after the roll paper cut command is issued without reducing the accuracy of ejection problem detection by the nozzle check process.

Figure 4:
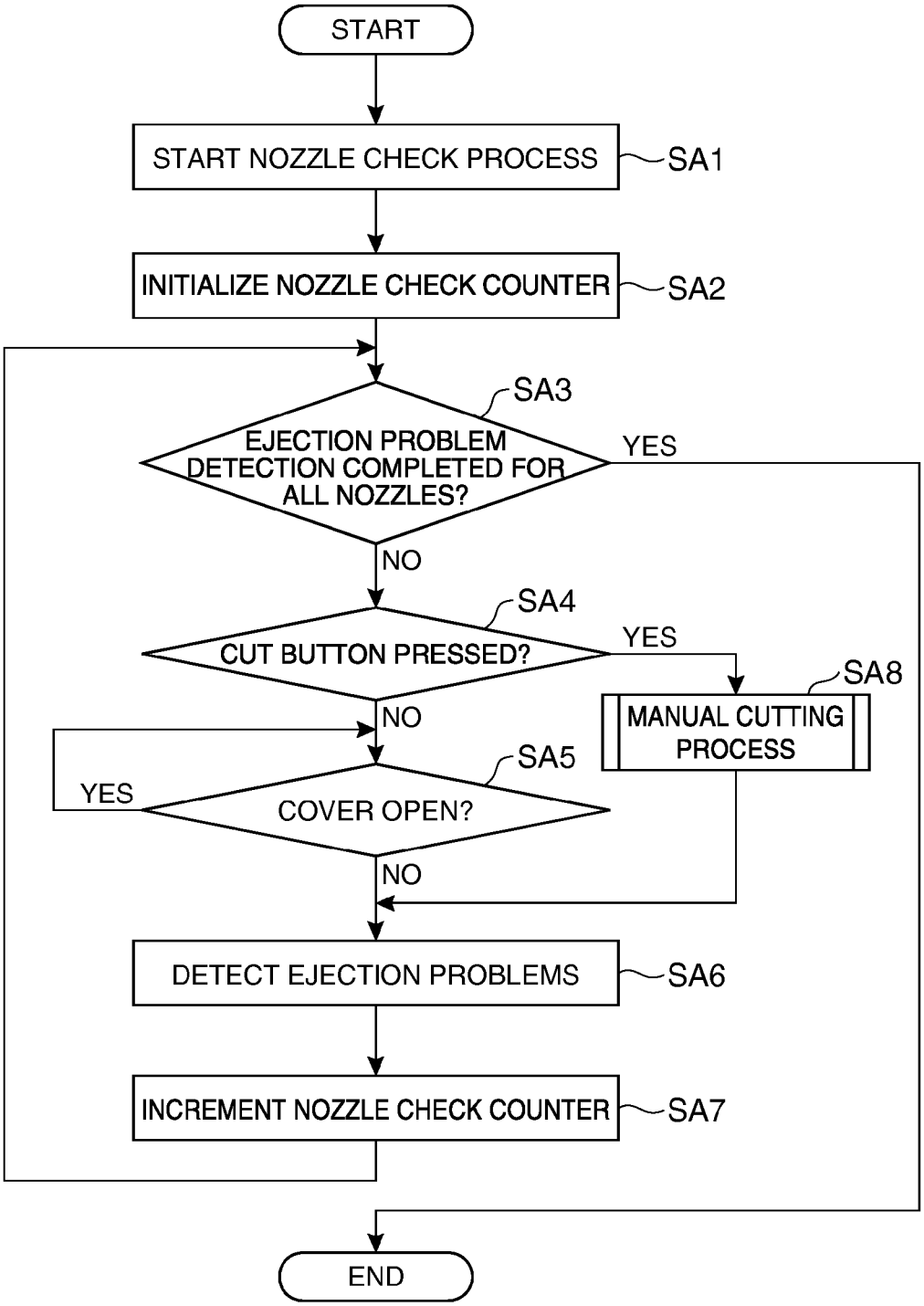
FIG. 4 is a flow chart showing an operation of the inkjet printer.

FIG. 4 is a flow chart showing the operation of the nozzle check process in a inkjet printer 1 according to this embodiment of the invention.

First, the nozzle check execution unit 32 of the control unit 23 of the inkjet printer 1 starts the nozzle check process (step SA1). The start of the nozzle check process is triggered by predetermined specific conditions being met, or by a user command.

Next, the nozzle check execution unit 32 initializes a nozzle check counter (step SA2).

The nozzle check counter conceptually represents a variable that is defined by a program for managing the nozzle that is tested for ejection problems in the nozzle check process, and is an integer that is initialized to 0. As described above, the nozzle check process according to this embodiment of the invention sequentially checks all nozzles of the inkjet head 11 in a specific order for ejection problems. Of the nozzles disposed to the inkjet head 11, the first nozzle that is checked for ejection problems is number 0, and the nozzles are numbered consecutively in the order in which the nozzles are checked for ejection problems. For example, If the inkjet head 11 has 100 nozzles, the nozzle that is checked first for ejection problems is number 0, and the remaining nozzles are numbered sequentially from 1 to 99 in the order in which the nozzles are checked for ejection problems. When detection of ejection problems is completed for one nozzle in this nozzle check process, the nozzle check counter is incremented so that the number assigned to the nozzle being checked for ejection problems and the value of the nozzle check counter match. As a result, the nozzle being checked for ejection problems, the nozzles that have already been checked for ejection problems, and the nozzles that have not been checked can be determined by reading the nozzle check counter. For example, if the inkjet head 11 has 100 nozzles assigned numbers 0 to 99, and the value of the nozzle check counter is 50, the nozzle checked for ejection problems is nozzle number 50, detection of ejection problems has been completed for nozzles 0 to 49, and detection of ejection problems has not been completed for nozzles 50 to 99.

The nozzle check execution unit 32 then determines if detection of ejection problems has been completed for all nozzles (step SA3).

If detection of ejection problems has been completed for all nozzles (step SA3 returns Yes), the nozzle check execution unit 32 ends the process.

If there is a nozzle for which detection of ejection problems has not been completed (step SA3 returns No), the nozzle check execution unit 32 determines if the cut button 30 was pressed and cutting the roll paper was commanded between when the nozzle check process started and the present time if the value of the nozzle check counter is 0, and between when step SA4 was executed and the present if the nozzle check counter is not 0 (step SA4).

If the cut button 30 has not been pressed (step SA4 returns No), the nozzle check execution unit 32 determines based on the output from the cover sensor 34 if the cover is open (step SA5).

If the cover is open (step SA5 returns Yes), the nozzle check execution unit 32 continues monitoring the position of the cover and delays moving to the next step until the cover is closed. More specifically, when the cover is open, the nozzle check execution unit 32 stops the nozzle check process until the cover is closed. The reason for this is described next.

If the cover is open, a task such as loading roll paper into the inkjet printer 1 may be in progress, and the task may adversely affect the accuracy of detecting ejection problems in the nozzle check process. In addition, if the cover is open, performing the nozzle check process while the inside of the printer is exposed is inappropriate in terms of maintaining the accuracy of the nozzle check process and safety. As a result, this embodiment of the invention stops the nozzle check process when the cover is open until the cover closes again, and thereby eliminates the adverse effect of an open cover on the accuracy of detecting ejection problems by the nozzle check process. However, if in step SA5 the cover is closed (step SA5 returns No), the nozzle check execution unit 32 determines the nozzle to be tested for ejection problems by referencing the nozzle check counter, and checks the nozzle for ejection problems using the method described above (step SA6). The detection result is then stored in a specific area in the storage unit 27.

Next, the nozzle check execution unit 32 increments the nozzle check counter (step SA7), and the process returns to step SA3.

However, if in step SA4 the cut button 30 was pressed (step SA4 returns Yes), the nozzle check execution unit 32 performs a manual cutting process (step SA8).

Figure 5:
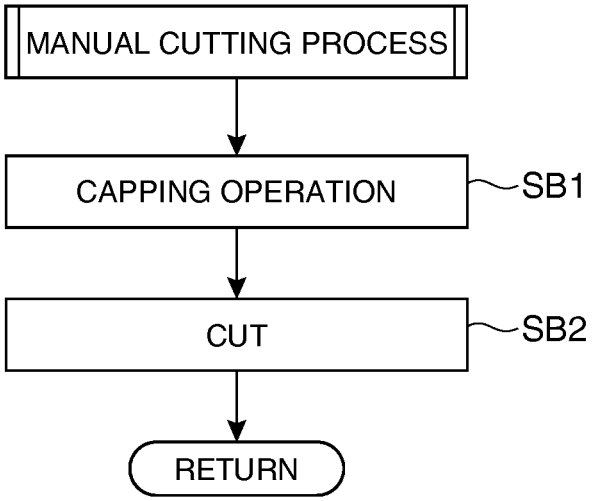
FIG. 5 is a flow chart showing an operation of the inkjet printer.

FIG. 5 is a flow chart of the manual cutting process performed in step SA8.

In the manual cutting process the nozzle check execution unit 32 first executes the capping operation (step SB1).

Next, the nozzle check execution unit 32 controls the cutter unit 31 and cuts the roll paper (step SB2).

Referring again to FIG. 4, after performing the manual cutting process in step SA8, the nozzle check execution unit 32 goes to step SA6 and using the method described above detects ejection problems in the nozzle selected for detection of ejection problems. After detection, the process goes to step SA7 and returns to step SA3, and the nozzles that have not been tested are thus tested without excess or deficiency. As will also be clear from the flow chart in FIG. 4, if the cut button 30 is pressed again after detection resumes, the nozzle check execution unit 32 interrupts the nozzle check process and performs the manual cutting process.

When the cut button 30 is pressed to assert a roll paper cut command while a nozzle check process is in progress, the nozzle check execution unit 32 interrupts the nozzle check process, cuts the roll paper, and then proceeds to test the next nozzle that has not been checked for ejection problems. As a result, the time lag between when a specific operation is commanded and when the specific operation starts can be shortened, and user concerns caused by a time lag can be alleviated.

More specifically, FIG. 3B shows the relationship between the passage of time, the start of each process, and the end of the process when the process shown in the flow chart in FIG. 4 is executed.

As shown in FIG. 3B, when the nozzle check process starts at time T1 and the cut button 30 is then pressed at time T2, the nozzle check process is interrupted, the capping operation started, and the cutting process then starts at time T5 at which the capping operation ends. As a result, the time lag TL2 between time T2 when the cut button 30 is pressed and time T5 when the cutting process actually starts is shorter than the time lag TL1 in the related art, and user concerns caused by the time lag can be alleviated.

In addition, because testing nozzles for which detection of ejection problems has not been completed is neither excessive nor deficient after the cutting process ends, nozzle testing is not incomplete, and the accuracy of ejection problem detection by the nozzle check process does not drop.

As described above, the nozzle check execution unit 32 of a inkjet printer 1 according to this embodiment of the invention sequentially detects ejection problems in a plurality of nozzles after starting the nozzle check process, monitors assertion of a command for performing the cutting process, which cannot be performed simultaneously to the nozzle check process, and if executing a cutting process is commanded, interrupts the nozzle check process, performs the cutting process, then resumes the nozzle check process, and tests the nozzles that have yet to be checked.

As a result, because the nozzle check process is interrupted, the cutting process is performed, and the nozzles that have not been checked for ejection problems are then tested if executing a cutting processing, which cannot be performed at the same time as the nozzle check process, is commanded while the nozzle check process is in progress, the time lag until the cutting process starts after executing the cutting process is commanded can be shortened, and user concerns caused by the time lag can be alleviated. Furthermore, because this embodiment results in all nozzles being tested for ejection problems, the accuracy of ejection problem detection by the nozzle check process does not drop.

In this embodiment of the invention the nozzle check execution unit 32 ejects ink droplets from the nozzle onto an electrical conductor, detects the current flowing through the conductor, and based on the detected current determines if there is an ink ejection problem, and the nozzle check process and the cutting process that produces noise that can adversely affect current detection are not performed simultaneously.

As a result, by preventing executing operations that have an adverse effect on the accuracy of detecting ejection problems while the nozzle check process is in progress according to the status of the nozzle check process, user concerns resulting from the time lag between when a specific operation is commanded and the start of the specific operation can be reduced without reducing the accuracy of ejection problem detection by the nozzle check process.

This embodiment of the invention also has a cut button 30 (input unit) enabling inputting a command for cutting the roll paper with the cutter unit 31.

This configuration enables commanding cutting the roll paper appropriately by means of the cut button 30, and can reduce user concerns caused by the time lag between issuing a cut command and the start of cutting even if the cut button 30 is pressed to cut the paper while the nozzle check process is in progress.

In addition, the nozzle check execution unit 32 in this embodiment determines if the cover is open while the nozzle check process is in progress, and if the cover is open, stops the nozzle check process until the cover closes.

As a result, adverse effects on the accuracy of ejection problem detection by the nozzle check process resulting from the cover being open can be eliminated.

Embodiment 2

A second embodiment of the invention is described next.

When the cut button 30 is pressed while the nozzle check process is in progress in the foregoing embodiment, the nozzle check execution unit 32 interrupts the nozzle check process and then performs the manual cutting process.

However, if the cut button 30 is pressed when the nozzle check process will soon end, performing the specific operation after the nozzle check process ends is more efficient, the time lag between when executing the specific operation is commanded and when the specific operation starts is also short, and user concerns are limited. Therefore, when the cut button 30 is pressed to execute the cutting process while the nozzle check process is in progress, the nozzle check execution unit 32 according to this embodiment of the invention operates as follows.

Figure 6:
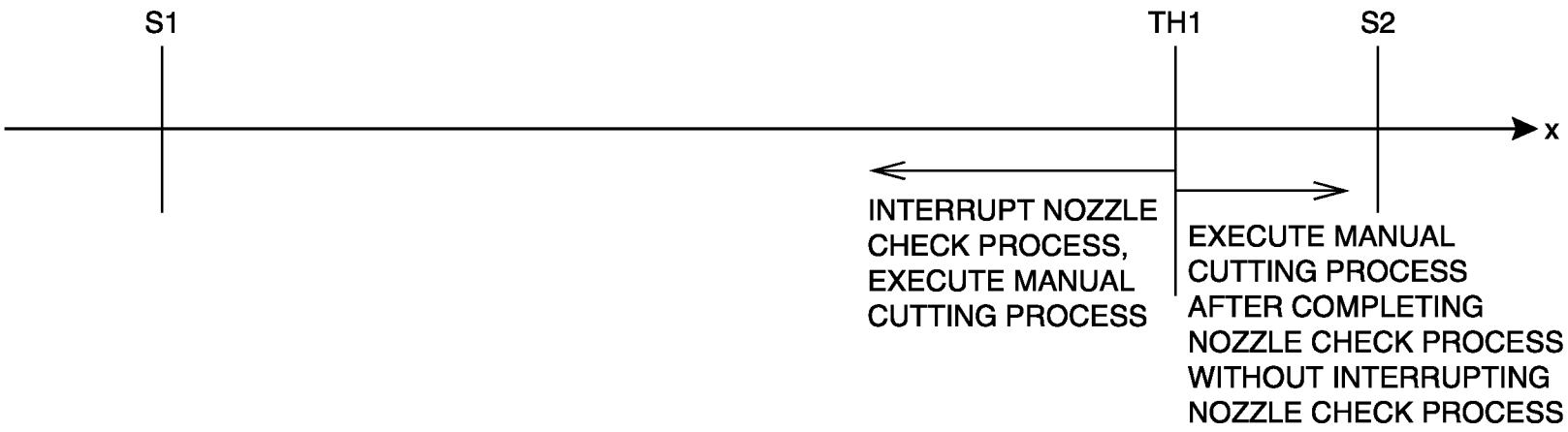
FIG. 6 shows the timing of processes performed by a printer according to a second embodiment of the invention.

FIG. 6 describes the operation of the nozzle check execution unit 32 in this embodiment of the invention.

In FIG. 6 the x-axis shows the passage of time with time progressing from left to right in the figure. Time S1 on the x-axis is when the nozzle check process starts, and time S2 is when the nozzle check process ends when the nozzle check process is performed without interruption after starting the nozzle check process at time S1.

In this embodiment, when the cut button 30 is pressed before time TH1 passes after the start of the nozzle check process at time S1, the nozzle check execution unit 32 interrupts the nozzle check process and performs the cutting process as described in embodiment 1 above, but if the cut button 30 is pressed after time TH1 passes, the nozzle check execution unit 32 executes the cutting process after completing the nozzle check process without interrupting the nozzle check process. This time TH1 is set desirably based on past experience or simulation with consideration for improving process efficiency and reducing user concerns caused by the time lag between when the cut button 30 is pressed and when the cutting process actually starts. As a result, process efficiency can be improved while reducing user concerns caused by a time lag.

As described above, if executing the cutting process is commanded after time TH1 has passed since the start of the nozzle check process, the nozzle check execution unit 32 according to this embodiment of the invention completes the nozzle check process without interrupting the nozzle check process, and then performs the cutting process.

As a result, process efficiency can be improved while suppressing user concerns caused by a time lag.

The embodiments described above are simply preferred embodiments of the invention, and can be varied and applied as desired without departing from the scope of the invention.

For example, a process that cuts the roll paper by the cutter unit 31 is described as an example of a specific operation that cannot be performed simultaneously to the nozzle check process in the embodiments described above, but the invention is not so limited and the specific operation could be another process that produces noise, or flushing or cleaning operations that use the inkjet head 11, for example. More specifically, specific operations that cannot be performed simultaneously to the nozzle check conceptually include all operations that cannot be performed simultaneously to the nozzle check because the operation affects the accuracy of ejection problem detection or due to some other hardware or software reason.

In addition, the function blocks shown in FIG. 1 can be achieved by the cooperation of hardware and software, and do not suggest a specific hardware configuration.

In addition, the function of the control unit 23 could be rendered by a separate device externally connected to the inkjet printer 1.

The steps of the flow charts shown in FIG. 4 and FIG. 5 can also be rendered by running a program stored in an externally connected storage medium.

What is claimed is:

1. A recording device comprising:

a recording head comprising a plurality of nozzles;

a switch;

an input unit configured to detect an operation of the switch and output a command; and a control unit that:

performs a nozzle maintenance process;

after starting execution of the nozzle maintenance process, monitors assertion of the command for performing a specific operation; and when executing the specific operation is commanded by the command, interrupts the nozzle maintenance process, performs the specific operation, and then resumes the nozzle maintenance process.

2. The recording device described in claim 1, wherein after resuming the nozzle maintenance process, the control unit performs the nozzle maintenance process on a one of the nozzles on which the nozzle maintenance process has not yet been performed.

3. The recording device described in claim 1, wherein the specific operation is an operation that affects the accuracy of the nozzle maintenance process.

4. The recording device described in claim 3, wherein:

the control unit ejects ink droplets from the nozzles onto a conductor, detects current flowing through the conductor, and based on the detected current determines if there is an ink ejection problem; and the specific operation is an operation that produces noise, wherein, if the specific operation were performed simultaneously to the nozzle maintenance process, the noise would adversely affect current detection.

5. The recording device described in claim 4, wherein the control unit performs the specific operation after covering a nozzle surface with a cap.

6. The recording device described in claim 3, further comprising a cutter unit that cuts a recording medium recorded on by the recording head; wherein the specific operation is an operation that cuts the recording medium by the cutter unit.

7. The recording device described in claim 1, wherein, when executing the specific operation is instructed after a specific time has passed after the nozzle maintenance process starts, the control unit executes the specific operation after completing the nozzle maintenance process without interrupting the nozzle check process.

8. A method of controlling a recording device comprising a recording head with a plurality of nozzles, a switch, and an input unit configured to detect an operation of the switch and output a command, the method comprising:

after starting execution of a nozzle maintenance process, monitoring assertion of the command for performing a specific operation; and when executing the specific operation is commanded by the command, interrupting the nozzle maintenance process, performing the specific operation, and then resuming the nozzle maintenance process.

9. The recording device control method described in claim 8, further comprising performing the nozzle maintenance process on a one of the nozzles on which the nozzle maintenance process has not yet been performed, after resuming the nozzle maintenance process.

10. The recording device control method described in claim 8, wherein the specific operation is an operation that affects the accuracy of the nozzle maintenance process.

11. The recording device control method described in claim 10, further comprising ejecting ink droplets from the nozzles onto a conductor, detecting current flowing through the conductor, and based on the detected current determining if there is an ink ejection problem;

wherein the specific operation is an operation that produces noise, wherein, if the specific operation were performed simultaneously to the nozzle maintenance process, the noise would adversely affect current detection.

12. The recording device control method described in claim 11, wherein:

the recording device further comprises a cutter unit that cuts a recording medium recorded on by the recording head; and the specific operation is an operation that cuts the recording medium by the cutter unit.

13. The recording device control method described in claim 11, further comprising covering a nozzle surface with a cap before performing the specific operation.

14. The recording device control method described in claim 8, further comprising, when executing the specific operation is instructed after a specific time has passed after the nozzle maintenance process starts, executing the specific operation after completing the nozzle maintenance process without interrupting the nozzle maintenance process.

15. A non-transitory storage medium storing a program that is executed by a control unit that controls a recording device comprising a recording head with a plurality of nozzles, a switch, and an input unit configured to detect an operation of the switch and output a command, the program causing the control unit to:

after starting execution of a nozzle maintenance process, monitor assertion of the command for performing a specific operation; and when executing the specific operation is commanded by the command, interrupt the nozzle maintenance process, perform the specific operation, and then resume the nozzle maintenance process.

* * * * *